US006802172B1

(12) United States Patent
Rouse et al.

(10) Patent No.: US 6,802,172 B1
(45) Date of Patent: Oct. 12, 2004

(54) PARTICLE AEROSOL BELT

(75) Inventors: William G. Rouse, Havre De Grace, MD (US); Raymond J. Malecki, Towson, MD (US); Warren C. Schimpf, Wilmington, DE (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/300,496

(22) Filed: Nov. 20, 2002

(51) Int. Cl.[7] ..... B65B 43/04; B65B 61/18

(52) U.S. Cl. ..... 53/412; 53/440; 53/449; 53/455

(58) Field of Search ..... 53/440, 455, 412, 53/449, 591

(56) References Cited

U.S. PATENT DOCUMENTS 2,194,451 A * 3/1940 Soubier ..... 53/449
2,912,805 A * 11/1959 Maynard ..... 53/427
2,925,719 A * 2/1960 Robbins ..... 53/449
3,267,633 A * 8/1966 Goodman ..... 53/427
3,372,797 A * 3/1968 Grevich ..... 53/412
4,752,002 A * 6/1988 Takahashi et al. ..... 206/204
4,860,899 A * 8/1989 McKee ..... 206/534
6,076,671 A 6/2000 Malecki et al.
6,170,234 B1 1/2001 Malecki et al.

* cited by examiner

*Primary Examiner*—John Sipos
(74) *Attorney, Agent, or Firm*—Ulysses John Biffoni

(57) ABSTRACT

A particle aerosol belt has a double-seal construction. A first zip-lock container contains the dry aerosol particles, such as brass metallic flake. The zip-lock containers are then placed in an elongate tubing. The tubing is sealed between the zip-lock containers to form a plurality of cells in which the zip-lock containers are disposed. A method of forming the particle aerosol belt includes introducing the brass metallic flake or other material, in the form of a slurry into the zip-lock containers, and drying the slurry, prior to sealing the zip-lock containers.

8 Claims, 2 Drawing Sheets

PARTICLE AEROSOL BELT

BACKGROUND OF THE INVENTION

I. Field of the Invention

The present invention relates to a method of making a continuous belt of individually sealed containers and the belt formed thereby. The present invention includes first sealing the individual containers, before placing the sealed containers into separate compartments or cells in the belt.

II. Description of the Prior Art

Aerosols are suspensions of solid particles dispersed in the air. Aerosols are used in the military to defensively position and protect combat forces. In civilian use, aerosol dispersal is used by police for riot control and by farmers for agricultural purposes. These solid particle payloads have included smokes, obscurants, riot control agents, insecticides, pesticides, fungicides, fertilizer, feed and other similar compounds.

The military has used a multitude of devices ranging from pneumatic spray tanks to high explosive (HE) grenades to disperse a variety of solid particle payloads into the atmosphere. During military operations, a military force may be targeted by visual means, ultraviolet, infrared (IR), and millimeter (mm) radar sensors. In countering this targeting, various types of filler payloads are used for aerosol dissemination. These payloads include carbon fiber payloads to block energy in the mm region of the electromagnetic spectrum, smokes to obscure military forces from visual detection, and brass flakes or graphite flakes which interfere with IR tracking and target acquisition devices.

Current military IR dispersion techniques require that military personnel load IR material from bulk bag containers. Personnel physically remove the filler material from large bags and place the filler into a separate hopper for dispersion. Generally, the filler is dirty to handle. The particles also may create hazardous toxic atmospheric dust during the loading phase, presenting a health risk to the personnel handling the filler. Typically, the materials include fillers such as pelletized graphite shipped in 30 pound bags.

In civilian use, aerosols are dispersed by police as a non-lethal means for crowd dispersal, riot control, personal protectants and/or incapacitating agents. Additionally, aerosols used for civilian commercial purposes include the dispersal of aerosols for agricultural uses, such as disseminating insecticides, pesticides, fertilizers or feed over a wide area. The dispersal of aerosol particles for both military and civilian use should have safe handling and activation characteristics.

U.S. Pat. Nos. 6,076,671 and 6,170,234, both of which are hereby incorporated by reference in their entireties, describe a typical solid particle aerosol belt and methods for disseminating the contents of such belts.

However, conventional particle aerosol belts have various shortcomings. The most significant of these is due to the design of the belt itself. The basic design of known belts incorporate a heat seal, running the length of the belt.

Studies of such conventional heat sealed belts revealed the contamination of the heat seal surface by the contents of the belt, such as brass flake. This contamination often causes the heat seal to become ineffectual preventing the complete adherence of the surfaces.

Accordingly, zipper sealed belts were developed. In such belts, the heat seals, entrapping the brass flake or other material in the individual cells were replaced by standard zipper lock systems. The surface of the belt exiting beyond the zipper lock was thoroughly cleaned once the flakes were inserted into the cells, to allow heat sealing of the belt surface.

This two-seal system presented other disadvantages. First, excessive manual labor to clean the belt to permit effective heat seals is required. Additionally, because of the zipper lock, the heat seal used to separate the individual cells cannot extend completely across the face of the belt. This leaves a passageway connecting the cells, allowing the materials contained therein to "leak" from cell to cell. Therefore, if a belt were partially used, such as described by U.S. Pat. No. 6,076,617, the material contained in the unused cells could exit the cells and enter the atmosphere through these continuous passageways. The result would often include loss of material, contamination of packaging and surrounding surfaces, as well as inferior performance.

Additionally, the conventional process of filling a particle aerosol belt is a dry fill method. However, the present inventors learned that it is not practical to simply dispense dry particulate matter into the containers having an opening with a zip-type fastener such as a ZIP LOCK fastener used in the present invention, as such a dry fill process presented difficulties in maximizing packing density and minimizing contamination of the brass flake onto outer surfaces of either the zip-fastener type containers or the belt itself. No dry filling technique, including pressurized syringe filling, pouring or metering pumping solved the problem. Additionally, after subjecting the cells to a vacuum to remove air from the cells, it has shown to be nearly impossible to transfer the filled and evacuated cells to another work station for sealing without reintroducing air back into the cells.

SUMMARY OF THE INVENTION

The present invention is a double-seal system for particle aerosol belts, which overcomes the problems of the conventional dual-seal particle belts. Specifically, the particle belt of the present invention includes a separate zip-fastener type container disposed inside the individual cells of the belt, as well as a method for producing the belt.

Because the material is first filled into a zip-fastener type container, the material can be sufficiently sealed to prevent escape of particles and/or any cross contamination. Specifically, the process of the present invention includes sealing the zip fastener containers with the brass flake therein, prior to placing the zip-fastener containers in the belt. It is therefore possible to handle the sealed zip-fastener containers without risking leakage or contamination of the belt prior to heat-sealing thereof.

In order to overcome the problems associated with dry filling of the brass flake, the preset inventors have developed a procedure involving a slurry. The slurry generally contains a heterogeneous mixture of the particulate material and a liquid. Once the slurry is introduced into the containers, the slurry is dried, leaving the dry particulate behind.

DESCRIPTION OF THE PREFERRED EMBODIMENTS

The present invention is a solid particle aerosol belt. As background, it is noted that U.S. Pat. No. 6,170,234, hereby incorporated by reference in its entirety discloses a solid particle aerosol belt, as well as a method for manufacturing the solid particle aerosol belt.

Figure 1:
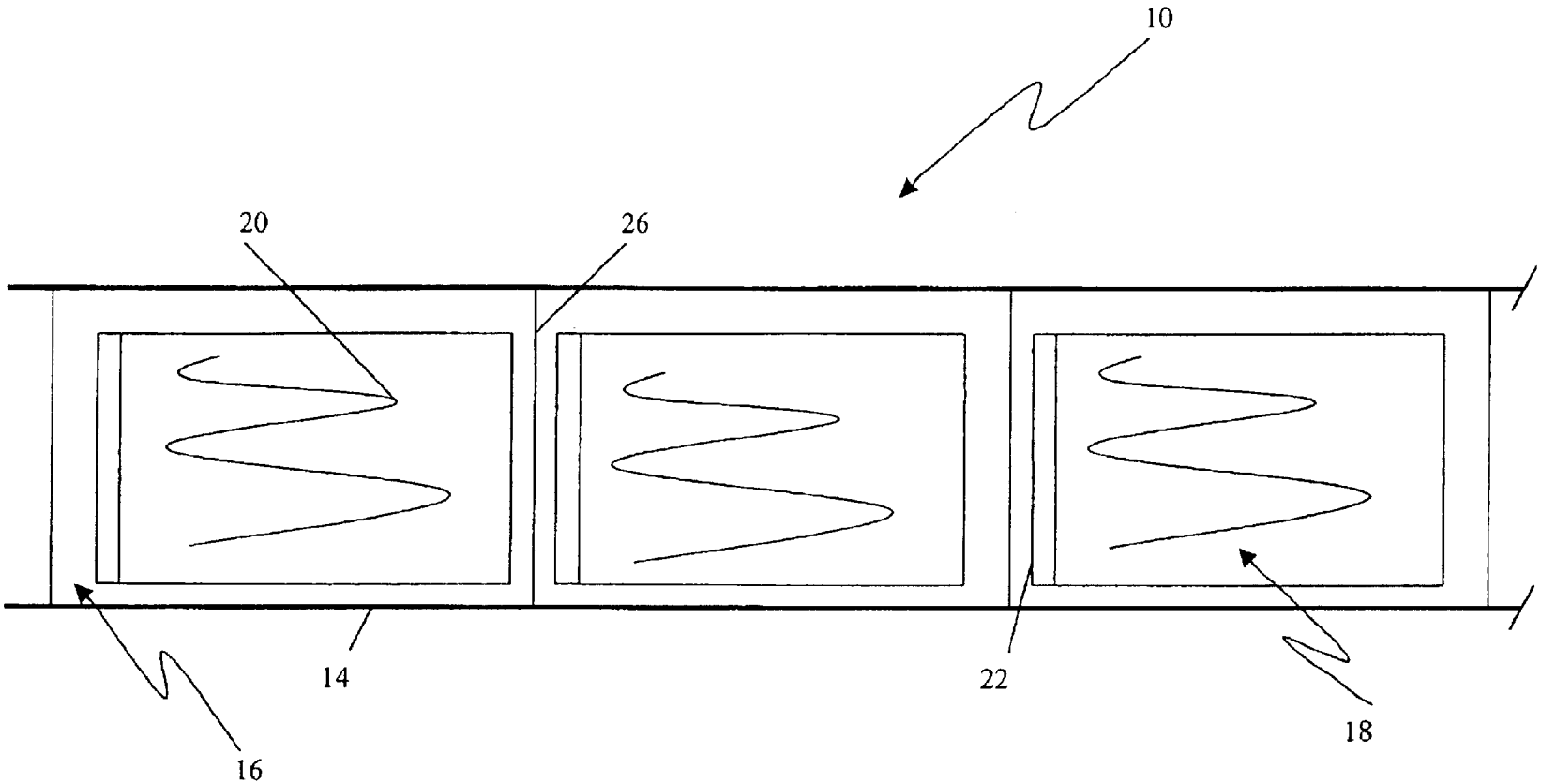
FIG. 1 illustrates a solid particle aerosol belt of the present invention.

FIG. 1 shows a typical structure of the double-sealed particle aerosol belt 10 of the present invention. Belt 10 generally includes a flexible elongate container 14, with a plurality of cells 16 therein. A zip-fastener container 18 is disposed in each of cells 16, with a material 20 placed inside zip-fastener containers 18. Each zip-fastener container includes its own zipper seal 22. Finally, the individual zip-fastener containers 18 are contained within their respective cells via heat seals 26, disposed between each of the cells 16. Because material 20 is behind two separate seals, the particle belt of this invention can be described as being double-sealed, in contrast to conventional particle belts, wherein the internal material is behind only one seal.

Material 20 can be any solid particulate substance, such as a material capable of being dispersed in aerosol form. In one embodiment, the particulate may be a smoke, obscurant, riot control agent, insecticide, pesticide, fungicide, fertilizer or feed. Additionally, material 20 may be a pharmaceutical composition, seed, confetti, or any other composition to be delivered in the form of an airborne mist. Preferably, material 20 is an infrared screening material flake, such as brass, capable of interfering with infrared tracking and targeting devices. In other embodiments, material 20 may be a fire retardant or extinguishing agent, or any other chemical to be dispersed in the air. Material 20 may also be a bioremediation substance, such as an enzyme or microorganism to be airborne delivered.

Zip-fastener container 18, typically is a flexible plastic bag including a zipper seal 22 on one side. Although not required by the invention, it is preferable that zipper seal 22 be air-tight, such that material 20 cannot leak out. As will be discussed below, zipper seal 22 only need to prevent the escape of material 20, as well as any additional compositions used during manufacture of belt 10. For example, zip-fastener container 18 may be a ZIP-PACK bag from Associated Bag Company of Milwaukee, Wis. Such zip-fastener containers 18 are generally formed from a plastic, such a polyethylene or polypropylene, but any similar plastic material is sufficient.

Flexible elongate container 14 is also typically formed from a plastic material. In one embodiment, a polypropylene tube, such as layflat tubing, is used as elongate container 14. For example, a 3"×3 mil thick heat sealable plastic tubing may be used. Again, the invention does not significantly limit the particular composition of elongate container 14. Although, preferably, elongate container 14 is made of a material impervious to material 20, such a feature is not required, as the structure of zip-fastener container 18 should be sufficient to prevent any leakage of material 20. Because the exterior surface of zip-fastener containers 18 are generally free from material 20, no material 20 should be present between zip-fastener containers 18 and the inner surface of elongate container 14. As will be described below; although elongate container 14 is preferably provided in the form of a tube, elongate container 14 may also be provided as a sheet which is folded, and subsequently axially sealed to produce a tube-like structure. Accordingly, the structure of elongate container 14 is not particularly limited.

In order to avoid the problems associated with conventional dry filling, a slurry process was developed by the present inventors. Although the above-described belt may be filled by conventional means, the method of the present invention overcomes the various disadvantages of such conventional means as detailed above. Preferably, brass flake is provided in a heterogeneous mixture consisting f70% (wt.) of brass flake with 30% wetting agent. More preferably, ethanol is selected as the wetting agent due to its consistency, ease of pumping and low temperature volatility. However, the wetting agent selected must be compatible with the composition of the selected material 20 and the zip-fastener container 18.

Figure 2:
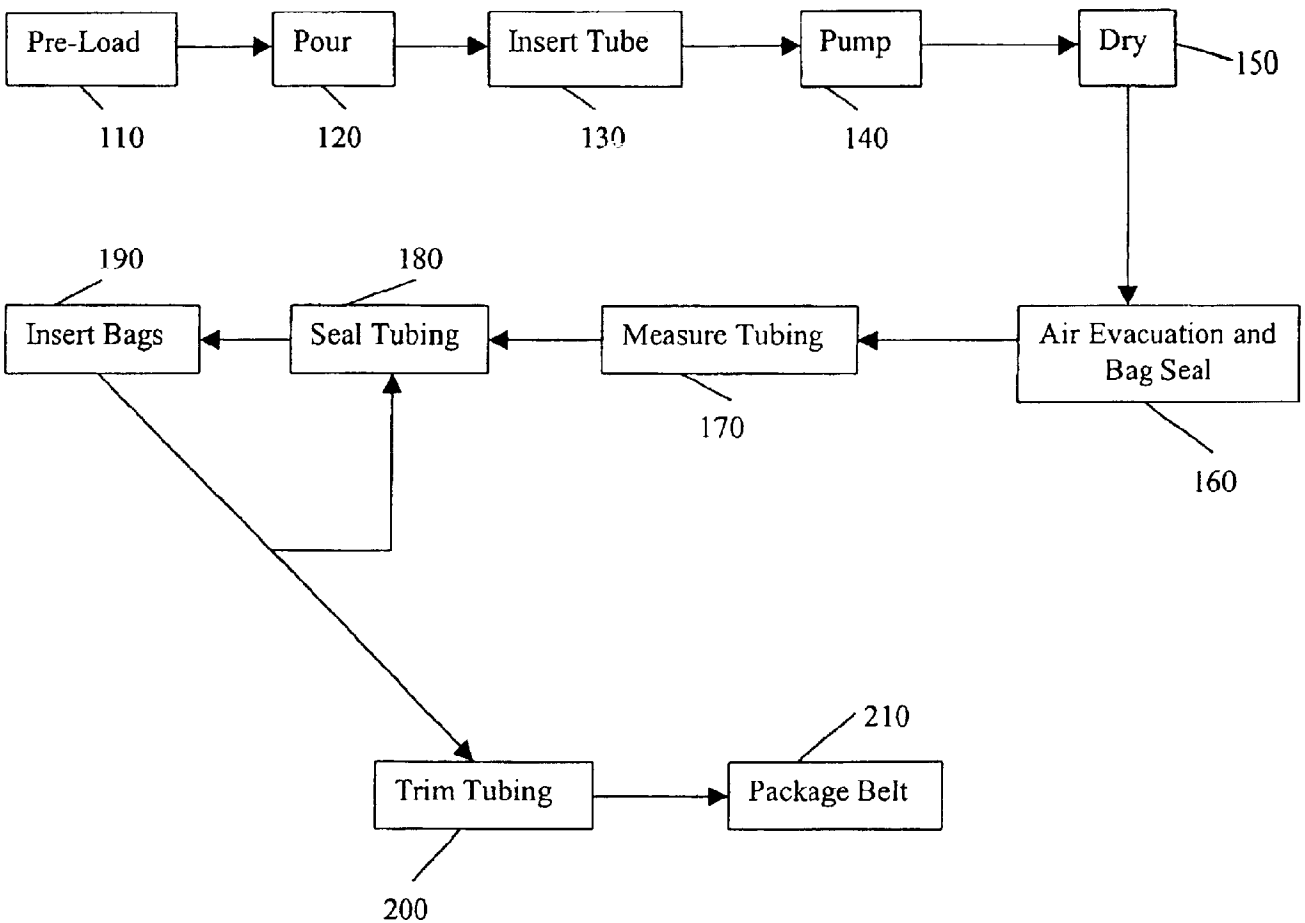
FIG. 2 is a flow chart, representing the steps of the method of the present invention.

A typical slurry process, according to the invention is shown in FIG. 2, wherein 2"−$^{5}$×2" ZIP-LOCK bags were used as zip-fastener containers 18. The ZIP LOCK bags were first placed into plastic holding containers, e.g., conventional 35 mm film canister with the bag left open at the top (Step 110). Separately, 5 lbs. of brass flake was placed in a 2 qt. container in an exhaust hood, to which 2.1 lbs. of ethanol was added. This mixture was whisked for 5 minutes to form the slurry (Step 120). A feed tube was inserted into the slurry (Step 130) and 28.6 g of the slurry (or 20 g of brass by dry weight) was pumped into each ZIP LOCK bag (Step 140). In order to ensure an even distribution of the slurry across the ZIP LOCK bags, each bag was first placed on an electronic balance and tared to zero grams before the introduction of the slurry. Once each bag was filled, it was placed, while open, in an aluminum tray for drying. The drying step comprised placing the filled aluminum tray, populated with filled ZIP LOCK bags, into an explosion proof forced air oven maintained at 80° C., until a constant weight is achieved (Step 150). Once dried, the bags were removed from the oven and allowed to cool.

Individually, each bag was placed in a finger roll assembly, wherein the bag is pulled tight over the rolls. Once as much air as possible has been expelled from the bag, it was sealed (Step 160). In order to prevent contamination of the later steps and the devices used to process the filled and sealed bags, the bags are typically wiped to remove any slurry or brass flake from the exterior thereof, and any excess plastic above the zipper lock was trimmed.

Next, an adequate amount of plastic tubing was measured out. The length of plastic tubing should be selected to be slightly greater than the total expected length of the belt (Step 170), which in this example is approximately 120 feet. Thereafter, although not required by the invention, in this example, one edge of the tubing was slit with a scissor or utility knife along its length. In another embodiment, it is possible to load the bags in the tubing directly without modifying the tubing. Starting at one end of the tubing, the tubing was placed in a heat sealer, for example Foot Impulse Sealer (Model AIE-600FI from American International Electric Co. of Santa Fe Springs, Calif.), preferably maintained at a heat setting of approximately 3.5 for 3 mil tubing, to produce a single seal orthogonal to the length of the tubing (Step 180).

One sealed brass-filled ZIP LOCK bag was placed into the tubing adjacent to the existing seal formed in Step 180 (Step 190). During this step, the bag was pushed close to the seal to limit the amount of space not occupied by the bag. When the bag is positioned correctly, another seal is formed in the tubing (Step 180). The tubing was placed in the heat sealer to make lengthwise seals as close as possible to the lengthwise edge of the bags. Typically, such seals are made in 18 inch intervals and overlapped by 0.25 inches to ensure good continuity and to prevent leakage through the cells. Steps 180 and 190 were repeated until a desired number of bags are inserted and sealed within the tubing. In this example, a total of 465 bags, corresponding to approximately 20.5 lbs. of brass, were placed in the tubing.

Once the belt is formed, any excess from the length of the belt was trimmed. In one embodiment the width is also trimmed, such that the belt measures between approximately 2.25 and approximately 2.3 inches in width (Step 200). However, this width is particularly selected to be compatible with both the storage means and device used to distribute the flakes. If the tube had been split along its length after Step 170, the tubing is then re-sealed before being trimmed.

The trimmed belt was then placed in a box for storage and shipment (Step 210). Approximately 10 inches of the belt is left outside a slot in the box, and the belt is fed down the inside of the box to the bottom. The belt is laid across the bottom of the box, in a back-and-forth manner until the belt completely fills the box. The belt is then fed through the outside slot as approximately 10 inches of the belt are left outside. Preferably, care should be taken to minimize any bends or creases in the brass flake-filled cells.

It will be appreciated by persons skilled in the art that the present invention is not limited to what has been particularly shown and described here in above. Rather, the scope of the present invention is defined only by the following claims.

What is claimed is:

1. A method for forming a particle aerosol belt, comprising:

(a) filling a plurality of containers with a particulate material wherein said filling step comprises:
providing said particulate in the form of a slurry;
introducing said slurry into said containers; and drying said slurry;

(b) sealing said plurality of containers;

(c) inserting, sequentially, said plurality of containers into a flexible elongate tube; and (d) heat sealing said elongate tube between each of said plurality of containers, such that each of said plurality of containers is permanently sealed and separated from adjacent containers by said heat seals.

2. The method of claim 1, wherein said plurality of containers comprise containers having a zip-fastener type opening.

3. The method of claim 1, wherein said slurry comprises 70% brass and 30% ethanol, by weight.

4. The method of claim 1, wherein said particulate material is selected from the group consisting of metallic particles, pharmaceutical compositions, smokes producing particles, obscurants, riot control agents, insecticides, pesticides, fungicides, fertilizer feed, seed confetti, bioremediation compositions, fire retardant and extinguishing agents.

5. The method of claim 4, wherein said particulate is a brass metallic flake.

6. The method of claim 2, wherein said sealing comprises:

expelling air from inside said containers having a zip-fastener type opening; and securing said zip-fastener type opening to prevent escape of said material.

7. The method of claim 1, further comprising feeding said belt into a box comprising:

dispensing said belt across the bottom of said box, and layering said belt, in a back and forth pattern, inside the box until the box is filled.

8. The method of claim 1, wherein:

(a) said filling step comprises filling a plurality containers having zip-fastener type openings with brass metallic flake comprising the steps of:

(b) said sealing step comprises sealing said plurality of containers having zip-fastener type openings comprising:
(i) expelling air from inside each of said plurality of containers having a zip-fastener type opening; and
(ii) securing each of said plurality of containers having a zip-fastener type opening to prevent escape of said brass metallic flake;

(c) said inserting step comprises inserting, sequentially, said sealed plurality of containers having a zip-fastener type opening into an elongate tube; and (d) said closing step comprises heat sealing said elongate tube between each of said plurality of containers, such that each of said plurality of containers is permanently sealed and separated from adjacent containers by said heat seals.

* * * * *